United States Patent [19]

Wittersheim

[11] 4,121,735

[45] Oct. 24, 1978

[54] SYSTEM FOR QUANTITY-CONTROLLED SPRAYING OF A LIQUID ACTIVE INGREDIENT

[75] Inventor: Adam Wittersheim, Ramstadt-Trautheim, Germany

[73] Assignee: Goldwell GmbH, Chemische Fabrik H.E.Dotter, Darmstadt-Eberstadt, Germany

[21] Appl. No.: 613,986

[22] Filed: Sep. 17, 1975

[30] Foreign Application Priority Data

Sep. 19, 1974 [DE] Fed. Rep. of Germany ..... 2444790

[51] Int. Cl.[2] ..... B67B 7/28

[52] U.S. Cl. ..... 222/83.5; 222/402.13; 141/20

[58] Field of Search ..... 222/83.5, 82, 89, 90, 222/398, 402.13, 402.24, 399, 80; 141/3, 10, 19, 20, 24, 329, 330

[56] References Cited

U.S. PATENT DOCUMENTS

| | | | |
|---|---|---|---|
| 2,642,064 | 6/1953 | Lawshe | 222/83 X |
| 2,899,106 | 8/1959 | Weinert | 222/83.5 X |
| 3,015,414 | 1/1962 | Wilson | 222/83.5 X |
| 3,141,583 | 7/1964 | Mapel et al. | 222/83.5 X |
| 3,273,606 | 9/1966 | O'Neill, Jr. | 141/3 |
| 3,366,148 | 1/1968 | Mizuguchi | 141/3 |
| 3,578,037 | 9/1969 | Flyn | 141/330 X |
| 3,698,453 | 10/1972 | Morane et al. | 141/20 X |
| 3,899,105 | 8/1975 | Fegley et al. | 222/83.5 X |
| 3,938,707 | 1/1976 | Schmit | 222/83.5 |
| 3,946,911 | 3/1976 | Morane et al. | 222/402.13 X |

*Primary Examiner*—Joseph F. Peters, Jr.
*Assistant Examiner*—Norman L. Stack, Jr.

[57] ABSTRACT

A container filled only partially with a pre-measured, exactly apportioned quantity of liquid active ingredient for one-time use closed in a pressure-tight manner by a closure made at least in part of a resilient material having self-resealing characteristics after piercing with a needle, and a reservoir filled with an aerosol propellant of a type incompatible with said active ingredient after a relatively short time when intermixed. The reservoir has a discharge valve with a hollow needle pushed through the resilient material of the closure and held by the material in a fluid-tight manner, whereby the container can be filled with the propellant only shortly before use of the active ingredient.

9 Claims, 3 Drawing Figures

SYSTEM FOR QUANTITY-CONTROLLED SPRAYING OF A LIQUID ACTIVE INGREDIENT

The invention relates to a system quantity-controlled spraying of a liquid active ingredient, using aerosol propellant, from a portion container filled with the requisite quantity of active ingredient, and to a spraying system for performing the method.

In recent years there has been increasing use by hair dressers of liquid hair care agents and fixatives, such as lacquer, which are sprayed on to the hair from aerosol spray cans; the spray can contains not only the active ingredient to be sprayed but also a special aerosol propellant, such as Frigen, which is liquid when under pressure, turns into gas when sprayed and causes the agent which it is required to spray to issue from the spraying valve as a fine mist. To ensure proper dosage and so that large heavy spray cans do not have to be handled, it is known to use small portion spray vials or the like adapted to be filled via a spraying valve or, if required, by means of a special filling valve on the valve of a supply can. Unfortunately, refillable portion containers of this kind can be used only with active ingredients which are chemically compatible with the propellant, so that there is no reaction between the same and the active ingredients even during prolonged storage and at high pressures; if chemical reactions were to occur during storage, one possible result might be the separation of crystals which would jam or block the spray nozzles. The supply cans must also be completely pressure-tight, and so they are now made preferably of steel sheet or plate of the required strength. Unfortunately, this feature makes it difficult to use aqueous active ingredients likely to rust the can. Painting the inside of the can prevents direct action of the spray agent on the can inside walls, but it is essential for the painting to be satisfactory and free from gaps, a requirement which greatly increases can production costs without completely precluding the risk of accidental damage to the paintwork. Plastics cannot be used for aerosol supply cans since plastics of acceptable cost would allow the propellant to escape slowly by diffusion.

On the other hand, it is an object of the invention to provide portion-wise spraying, by means of an aerosol propellant, of liquid substances which for the reasons just given it has so far been impossible to spray from aerosol cans and which have therefore had to be applied by direct wetting, such as e.g. permanent waving and hairdying liquids and other cosmetic or pharmaceutically active liquids.

According to this invention, to solve the problem the active ingredient to be sprayed is first filled in the portion container without propellant, the portion container is closed in sealing-tight manner, the aerosol propellant is introduced from a propellant reservoir into the portion container immediately before use, and the active ingredient is then sprayed from the portion container by means of an appropriate spraying head. Pressureless filling of the portion receptacle or container or the like solely with the active ingredient to be sprayed, and introduction of the aerosol propellant only at the time of actual use, makes it possible to use aerosol propellants for the application or spraying of almost any liquid irrespective of compatibility with the cans or with the liquid. Also, even if the portion containers are made of a cheap plastics which is not particularly pressure resistant nor completely impervious to the propellants, there will be little diffusion and resulting pressure loss; consequently, it becomes possible to use aqueous active ingredients which, as previously stated, can be filled either not at all or only at relatively high cost into sheet-metal cans.

In a preferred development of the invention, after filling with the active ingredient the portion container is closed by means of a closure facility made of a resilient substance which recloses hermetically after piercing by a needle, and the aerosol propellant is introduced through a narrow tube which has been pushed through the closure facility. In other words, unlike conventional portion spray containers, the portion spray containers used for the purposes of the invention do not have a mechanically expensive filling valve but are closed just by the resilient closure facility, e.g. a rubber plug.

The spray head can also be connected to the portion container interior by a narrow tube which is disposed on the spray head being pushed through the resilient material of the closure facility.

In the spraying system according to the invention, the active ingredient is filled in the portion containers without propellant and the filling orifice of the portion containers is closed in pressure-tight manner by a closure facility consisting to at least some extent of a resilient substance. Also forming part of the system according to the invention are: a reservoir filled or fillable with aerosol propellants, the reservoir discharge valve being connected to a narrow tube adapted to be pushed through the resilient substance of the closure facility; and a spraying head which also has a narrow tube and which can be secured through the agency thereof to the portion containers after the latter tube has been pushed through the closure facility.

Advantageously, the portion containers containing active ingredients are plastics vials or the like which are only partly filled with such ingredient. This feature not only helps to reduce costs but also makes it possible for active agents which would attack metal to be used. With regard to ability to resist chemical corrosion, portion containers made of glass can be used with advantage even though the risk of breakage is higher than with plastics.

The reason for only partly filling the containers — i.e., for container capacity to the overdimensioned relatively to the required quantity of active ingredient — is that sufficient space must be left in the containers for the propellant to be introduced before spraying. If the ingredient in the can tends to be altered by air, e.g. to oxidize, the ingredient can be vacuum filled or the remaining free space in the container can be filled with an inert gas, such as nitrogen, before closure.

The closure facility of the portion containers takes the form of a rubber or of a resilient plastics which provides a hermetic closure of the filling aperture of the closure facility; in the simplest case the closure facility can be a plug. Such materials, if of appropriate hardness, are self-resealing after piercing with a needle.

The rubber or resilient plastics closure member can be secured by means of a metal foil or sheet metal cap secured above the filling orifice. If the cap of metal in foil or sheet form can be wholly or partly torn off, it forms a tamper-proof closure which is a guarantee that, if the cap is undamaged, the active ingredient in the container is the maker's original filling.

The metal cap in foil or sheet form can be formed with a central aperture for the passage of the narrow tube of the propellant reservoir and of the spraying head. The portion container can then be filled with propellants, and the spraying head fitted, without removal of the cap.

Preferably, to prevent accidentical release of a spraying head which has been fitted to a portion container, when the spraying head is secured to the top of a portion container, the portion container and the spraying head engage with one another non-positively or positively by means of matching locking means engageable with one another. The locking means can take the form e.g. of catch projections which are provided on one of the two parts and which engage in matching recesses in the other part. Screwthreads and bayonet closures are alternative possibilities.

The spraying-head tube through which the active ingredient is removed from the portion containers must be of such a length that its unattached end extends substantially to the bottom of the container to which the spraying head has been fitted, in which event the tube serves as a riser. Conveniently, therefore, the spraying head is a receptacle which is open or openable on the bottom for the introduction of a portion container, the walls of the receptacle forming the spraying head being at least of such a length that the narrow tube associated with the sprayhead does not project from the open bottom. This feature prevents damage to the narrow tube, which must of course be pointed.

If the portion containers have a separate riser, e.g. a narrow plastics tube secured to the bottom of the rubber plug and extending to near the bottom of the container, the length of the tube secured to the spraying head need be only sufficient for such tube to be able to pierce the resilient material of which the closure facility is made. Tube length also depends upon the kind of spray required and upon the substance to be sprayed. Relatively short tubes can be used e.g. when the materials are required to be sprayed in foam form or when the spraying head is required to be used in an operative position which is the reverse of the normal position, in which the spraying valve points upwards — i.e., when the head is to be used in a position in which the spraying valve points downwards.

When the spraying head is in the form of an outer receptacle receiving the portion container, the spraying head is, conveniently, so devised as to engage closely around the portion container. In this event the same can be made of a soft plastics which, in the absence of support from the wall of the receptacle-like spraying attachment, would tend to distort.

Filling the portion containers is a simple operation, the discharge valve of the aerosol supply reservoir being operated by being pressed down against a biassing force after the fashion of the known aerosol spray cans; and the narrow tube associated with the propellant reservoir is rigidly secured in the downwardly pressable part of the discharge valve.

In this event, the biassing opposing depression of the discharge valve is such as to be greater than the force needed to pierce the closure facility of the portion containers. To inject the propellant, the portion container has its closure facility pressed on to the tube of the aerosol reservoir, the tube piercing the closure facility. Pressing the portion container further on to the aerosol reservoir depresses and therefore opens the discharge valve thereof and the propellant enters the portion container.

Advantageously, to protect the tube of the aerosol container from damage, the discharge valve of the propellant reservoir is protected by a known guard cap formed with an aperture of the introduction of the portion receptacles, the guard cap being of such a height that the narrow tube secured to the discharge valve does not project beyond the guard cap.

The invention will be described in greater detail hereinafter with reference to the drawings wherein.

Figure 1:
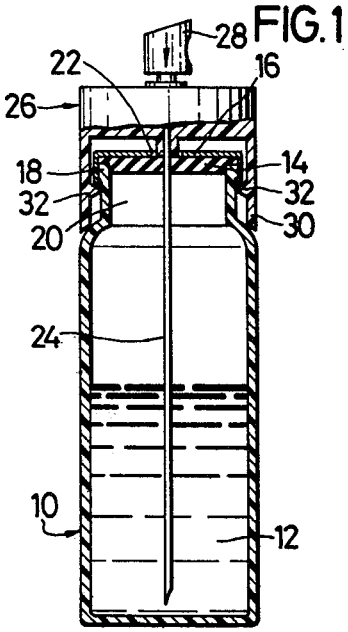
FIG. 1 is a sectioned view through a portion container, fitted with a spraying head, of use for the system according to the invention.

FIG. 1 shows a portion container 10 which resembles a conventional tube or the like for tablets or pills and which can be made of plastics or glass. A predetermined quantity of a liquid active ingredient 12 is filled in container 10, the same being only partly filled with the ingredient 12.

Container 10 is associated with a closure facility in the form of a rubber plug 14 which is secured over the filling end of container 10 by a metal foil cap 16. The same engages behind a peripheral bead 18 and the outside end of a reduced-diameter orifice 20 of the container 10.

The cap 10 of the embodiment shown is formed with a central aperture 22 giving access to the top of the rubber plug 14 underneath. By way of orifice 22 it is possible to engage a narrow tube 24 of a spraying head 26 which mounts on the top of the container 10, the tube 24 piercing the plug 14 and extending through the inside of container 10 to near the bottom thereof. As already stated, the length of the tube 24 also depends upon the kind of spraying required and upon the agent to be sprayed. The spraying head 26 has a valve mechanism adapted to be opened by depression of a control knob 28; the valve mechanism is of a kind conventional in aerosols spray cans and is therefore not shown.

The spraying head 26 shown in FIG. 1 engages merely over the necklike orifice 20 of the container 10, front edge 30 of head 26 bearing on the cross-sectional widening of the container 10 in the transition zone between the container orifice and the main part of the container. Projections 32 on the inside wall of the head 26 are a means of engagement between the head 26 and the orifice 20. Possible alternatives for the projections 32, assuming appropriate construction of the orifice 22 and head 26, are screw threaded or bayonet closure facilities.

Figure 2:
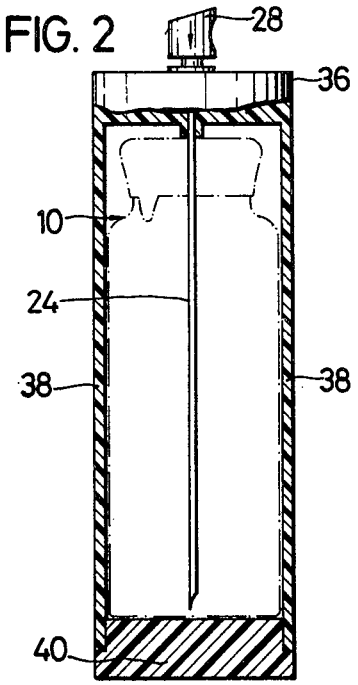
FIG. 2 shows another form of valve spraying head.

In contrast to the spraying head 26 of FIG. 1, in the case of sprayhead 36 shown in FIG. 2 the spray-head side walls 38 which engage over orifice 20 of the containers 10 are lengthened to an extent such that a portion container 20 introduced into the head 36 is completely surrounded thereby, a bottom cover 40 providing the captive mounting of the container 10 in the head 36. This form of head 36 has two considerable advantages:

1. The walls 38 of the head 36 extend completely around the tube 24, thus obviating any risk of damage to the pointed exposed end of tube 24, and 2. The side walls 38 and possibly the inside of the cover 40 can be used to bear, and relieve the pressure stressing of, the container 10 in cases in which the same is made of a soft plastics likely to be deformed by pressure.

Figure 3:
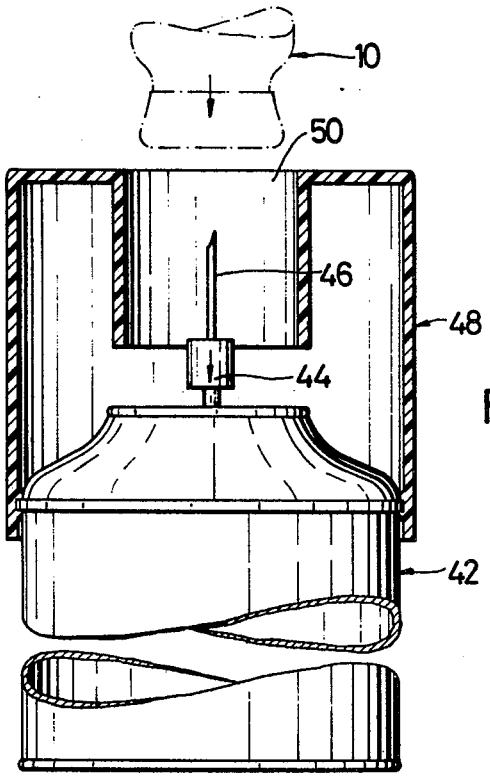
FIG. 3 is a side view of an aerosol reservoir, the guard cap being shown in section.

The aerosol supply reservoir 42 for filling the containers 10 with aerosol propellant is shown in FIG. 3 and corresponds in many ways to conventional aerosol spray cans except that it contains exclusively aerosol propellant, e.g., the one known under the trade mark of "Frigen". Operating or control knob 44 which in conventional aerosol spray cans contains the spraying nozzle has instead of such a nozzle a narrow tube 46 which can be pushed through the plug 14 of the containers 10 into the inside thereof. Once the tube 46 has penetrated inside the container 10 and the same, shown in chain-dotted lines in FIG. 3, has had its closure facility pushed into engagement with knob 44, pressing the container 10 down further on the knob 44 initiates filling. Filling is complete when propellant ceases to flow into the container 10 because the pressure therein is equal to the pressure in the reservoir 42.

There is no loss of pressure when container 10 is removed from tube 46, since the orifice pierced in the plug 14 recloses immediately.

Damage by tube 46 of the reservoir 42 is prevented by a guard cap 48 which is shown in section and which extends laterally around the tube 46; the cap 48 enables a container 10 to be pushed on to the tube 46 through a top orifice 50 without the cap 48 having to be removed from the reservoir 42 for this purpose. The cap 48 can therefore be produced as an integral unit with the reservoir 42.

Clearly, portion containers closed by a resilient closure facility, in association with the described spraying head having the narrow tube and with the aerosol propellant reservoir, which also has a narrow tube, form a spraying system in which the propellant is not brought into contact with the substance to be sprayed until immediately before spraying, so that the advantages hereinbefore discussed in detail become possible.

The spraying heads can readily be re-used with different spray agents, since cleaning and/or disinfection is readily possible by using the spraying head at intervals to spray a cleaning agent or a disinfecting agent.

What is claimed is:

1. In combination: a container filled only partially with a pre-measured, exactly apportioned quantity of a liquid active ingredient, for one-time use, and with an aerosol propellant of a type incompatible with said active ingredient after a relatively short time when intermixed with said active ingredient, a closure closing said container in a pressure-tight manner and being made at least in part of a resilient material having self-resealing characteristics after piercing with a needle, and a spray head detachably secured to said container and having a discharge valve and also having a hollow needle pushed through said closure into the liquid active ingredient in said container and held by said material in a fluid-tight manner, said hollow needle being connected to said discharge valve, whereby said entire quantity of liquid active ingredient and aerosol propellant can be sprayed relatively shortly after introduction of said aerosol into said container by actuating said discharge valve.

2. The combination according to claim 1, wherein the closure is made at least in part of rubber.

3. The combination according to claim 1, wherein the closure is made at least in part of plastic.

4. The combination according to claim 1, comprising a metal cap retaining the resilient part of the closure secured to the container.

5. The combination according to claim 4, wherein the metal cap is removable.

6. The combination according to claim 4, wherein the metal cap is formed with a central aperture for the passage of the tube.

7. The combination according to claim 1, wherein the spraying head has a receptacle adapted to receive said container, the walls of the receptacle being at least of such a length that the conduit of the spraying head is fully received within said container.

8. The combination according to claim 7, wherein the spraying head and the container have matching locking means engageable with one another.

9. The combination according to claim 7, wherein the spraying head engages closely around the container.

* * * * *